US009929519B1

(12) United States Patent
Hall et al.

(10) Patent No.: US 9,929,519 B1
(45) Date of Patent: Mar. 27, 2018

(54) ELECTRICAL CABLE CONNECTOR AND METHOD OF ASSEMBLING THE SAME

(71) Applicant: TYCO ELECTRONICS CORPORATION, Berwyn, PA (US)

(72) Inventors: John Wesley Hall, Harrisburg, PA (US); Douglas John Hardy, Middletown, PA (US); Sean Patrick McCarthy, Palmyra, PA (US); John Mark Myer, Millersville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/272,545

(22) Filed: Sep. 22, 2016

(51) Int. Cl.

| | |
|---|---|
| ***H01R 4/24*** | (2006.01) |
| ***H01R 4/26*** | (2006.01) |
| ***H01R 11/20*** | (2006.01) |
| ***H01R 24/40*** | (2011.01) |
| ***H01R 13/405*** | (2006.01) |
| ***H01R 13/6592*** | (2011.01) |
| ***H01R 43/20*** | (2006.01) |
| *H01R 103/00* | (2006.01) |

(52) U.S. Cl.
CPC ..... *H01R 24/40* (2013.01); *H01R 4/2454* (2013.01); *H01R 13/405* (2013.01); *H01R 13/6592* (2013.01); *H01R 43/20* (2013.01); *H01R 2103/00* (2013.01)

(58) Field of Classification Search
CPC .... H01R 9/0509; H01R 9/053; H01R 4/2445; H01R 4/2466
USPC ..... 439/394, 397, 752
See application file for complete search history.

(56) References Cited

U.S. PATENT DOCUMENTS

| | | | | |
|---|---|---|---|---|
| 6,384,335 | B1 * | 5/2002 | Saito | H01R 9/0518 174/74 R |
| 6,840,822 | B1 | 1/2005 | Hall et al. | |
| 7,160,150 | B2 * | 1/2007 | Annequin | H01R 43/048 439/585 |
| 7,160,152 | B2 | 1/2007 | Tsai | |
| 7,347,742 | B2 | 3/2008 | Hall et al. | |
| 7,682,205 | B2 * | 3/2010 | Hall | H01R 13/4361 439/752 |
| 7,785,118 | B2 * | 8/2010 | McCarthy | H01R 9/0518 439/578 |
| 9,673,578 | B1 * | 6/2017 | Lane | H01R 24/40 |
| 9,680,256 | B1 * | 6/2017 | Lane | H01R 13/6275 |
| 2003/0089517 | A1 * | 5/2003 | Takahashi | H01R 9/0518 174/78 |

* cited by examiner

*Primary Examiner* — Abdullah Riyami
*Assistant Examiner* — Thang Nguyen

(57) ABSTRACT

An electrical cable connector includes a contact subassembly having a center contact, a dielectric holder, and an outer contact. The dielectric holder defines a channel that is open at a top side of the dielectric holder. The center contact has a termination region that is held in the channel. The termination region includes a first cable insulation displacement (CID) feature. The outer contact includes a second CID feature extending from a base wall of the outer contact outside of the dielectric holder. The second CID feature extends into the channel through an aperture in the dielectric holder. The first CID feature engages a core conductor of a cable and the second CID feature engages a shield layer of the cable as the cable is loaded into the channel from above the top side of the dielectric holder.

20 Claims, 7 Drawing Sheets

ELECTRICAL CABLE CONNECTOR AND METHOD OF ASSEMBLING THE SAME

BACKGROUND OF THE INVENTION

The subject matter herein relates generally to electrical connectors that mount to electrical cables.

Electrical connectors have been used to interconnect coaxial cables. Coaxial cables are used in various radio frequency (RF) applications. In the automotive industry, for example, there is a demand for coaxial cables and connectors due in part to increased electrical devices within automobiles, such as AM/FM radios, cellular phones, GPS, satellite radios, wireless communication systems, and the like.

The production of coaxial cable connectors according to known methods is not without disadvantages, such as by involving a series of steps that may be difficult to automate, thus increasing costs and reducing production efficiency. For example, the assembly process of known coaxial cable connectors include cutting and stripping the coaxial cable; terminating a core of the cable to a center contact via a crimping or otherwise pressing process; loading the center contact and attached cable within a dielectric holder inside of an outer contact; preparing a shield layer of the cable to engage the outer contact; positioning a ferrule around the shield layer; and then crimping the ferrule to secure the cable to the outer contact and dielectric holder. Thus, the assembly process may include multiple pressing operations using different applicators that perform the pressing operations. A need remains for an electrical cable connector that is formed more efficiently by reducing the number of assembly steps, reducing the number of parts used in the assembly process, and/or increasing the suitability of the assembly process for automation.

BRIEF DESCRIPTION OF THE INVENTION

In one embodiment, a contact subassembly for an electrical cable connector is provided that includes a center contact, a dielectric holder, and an outer contact. The center contact has a mating interface and a termination region. The termination region includes a first cable insulation displacement (CID) feature defining a core slot sized to receive and engage a core conductor of a cable therein. The dielectric holder has a top side and defines a channel that is open at the top side. The center contact is held by the dielectric holder such that the termination region is received in the channel. The dielectric holder further defines an aperture extending through the dielectric holder from an outer surface thereof to the channel. The outer contact includes a base wall and a second CID feature extending from the base wall. The base wall engages the outer surface of the dielectric holder. The second CID feature extends through the aperture into the channel. The second CID feature includes blades that penetrate a jacket of the cable to engage and electrically connect to a shield layer of the cable as the cable is loaded into the channel from above the top side of the dielectric holder.

In another embodiment, an electrical cable connector is provided that includes a cable and a contact subassembly. The cable has an inner cable portion including a core conductor and an insulation layer surrounding the core conductor. The cable further includes an outer cable portion including a shield layer surrounding the insulation layer and a jacket surrounding the shield layer. The inner cable portion protrudes from the outer cable portion at an end segment of the cable. The contact subassembly includes a center contact, a dielectric holder, and an outer contact. The dielectric holder has a top side and defines a channel that is open at the top side. The center contact has a mating interface and a termination region. The center contact is held by the dielectric holder such that the termination region is disposed in the channel. The termination region includes a first cable insulation displacement (CID) feature having two contact walls that define a core slot therebetween. The outer contact at least partially surrounds the dielectric holder. The cable is received in the channel of the dielectric holder from above the top side of the dielectric holder such that the inner cable portion of the end segment is received in the core slot of the first CID feature. The contact walls of the first CID feature penetrate the insulation layer to engage and electrically connect to the core conductor of the cable.

In another embodiment, a method of assembling an electrical cable connector is provided that includes inserting a center contact into a dielectric holder. The dielectric holder has a top side and defines a channel that is open at the top side. The center contact has a mating interface and a termination region. The termination region is received in the channel. The termination region includes a first cable insulation displacement (CID) feature. The method also includes coupling the dielectric holder to an outer contact that at least partially surrounds the dielectric holder. The outer contact includes a base wall and a second CID feature extending from the base wall. The base wall engages an outer surface of the dielectric holder and the second CID feature extends through an aperture of the dielectric holder into the channel. The method further includes pressing a cable into the channel of the dielectric holder from above the top side of the dielectric holder such that the cable engages and terminates to both the first CID feature of the center contact and the second CID feature of the outer contact as the cable is pressed into the channel.

DETAILED DESCRIPTION OF THE INVENTION

Figure 1:
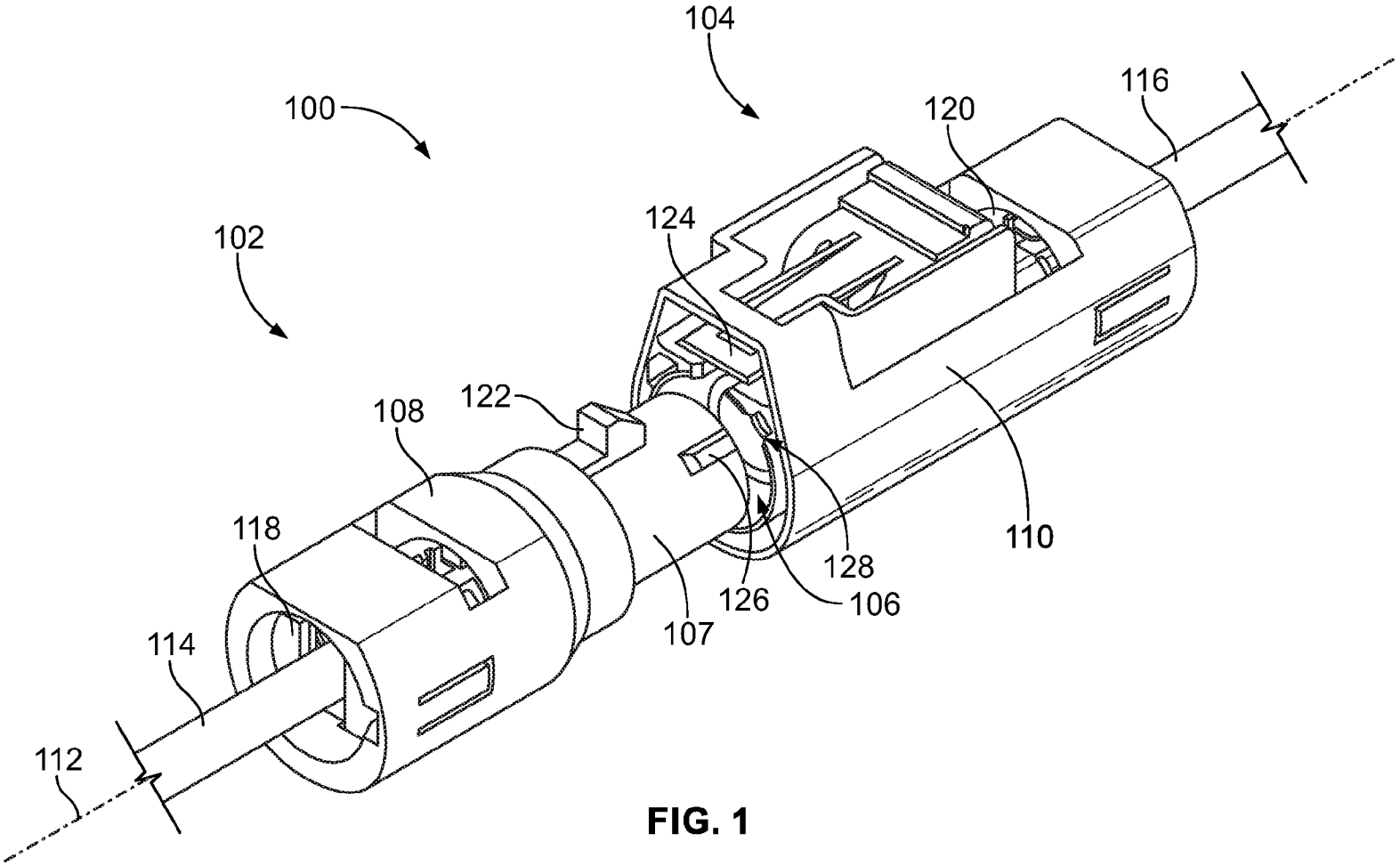
FIG. 1 illustrates a connector system formed in accordance with an exemplary embodiment.

FIG. 1 illustrates a connector system 100 formed in accordance with an exemplary embodiment. The connector system 100 includes a first electrical connector 102 and a second electrical connector 104 that are configured to be mated together to transmit electrical signals (for example, power, control signals, data, and/or the like) therebetween. In the illustrated embodiment, the first electrical connector 102 is a male connector, and the second electrical connector 104 is a female connector, such that a mating end of the first electrical connector 102 is received within a cavity 106 of the second electrical connector 104 during a mating operation. More specifically, a nose cone 107 of a housing 108 of the male connector 102 is received within the cavity 106 defined by a housing 110 of the female connector 104. Although shown as un-mated in FIG. 1, the male and female connectors 102, 104 are poised for mating along a mating axis 112.

The male connector 102 and the female connector 104 are mounted and electrically connected to corresponding coaxial electrical cables 114, 116, respectively. In an alternative embodiment, one of the male connector 102 or the female connector 104 may be mounted to a circuit board instead of a cable. The male and female connectors 102, 104 each include a respective contact subassembly 118, 120 located within the respective housing 108, 110. The contact subassembly 118 of the male connector 102 is terminated (for example, directly mechanically and electrically connected) to the cable 114, and the contact subassembly 120 of the female connector 104 is terminated to the cable 116. When the connectors 102, 104 are mated, complementary conductive components of the contact subassemblies 118, 120 engage each other to establish a conductive signal pathway across the connectors 102, 104 to connect the cables 114, 116.

The housing 108 of the male connector 102 includes a catch 122 that is configured to engage a complementary deflectable latch 124 on the housing 110 of the female connector 104 when the connectors 102, 104 are fully mated to secure the mated connection between the two connectors 102, 104. The contact subassemblies 118, 120 are securely held inside the corresponding housings 108, 110, such that the interconnection between the catch 122 and latch 124 of the housings 108, 110, respectively, retains the electrical connection between the contact subassemblies 118, 120. The latch 124 is able to be lifted or pivoted over the catch 122 in order to disconnect the male and female connectors 102, 104.

In the illustrated embodiment, the male connector 102 and the female connector 104 constitute FAKRA connectors which comply with the standard for a uniform connector system established by the FAKRA automobile expert group. FAKRA is the Automotive Standards Committee in the German Institute for Standardization, representing international standardization interests in the automotive field. The FAKRA connectors have a standardized keying system and locking system that fulfill the high functional and safety requirements of automotive applications by restricting the mate-ability of each of the connectors 102, 104 to one or more specific mating connectors according to the FAKRA standards. For example, the male connector 102 in the illustrated embodiment has one or more keying ribs 126, and the female connector 104 has one or more keyholes 128 that receive the keying ribs 126 when the connectors 102, 104 are mated and properly aligned. In an alternative embodiment, the male and female connectors 102, 104 are not FAKRA connectors.

Figure 2:
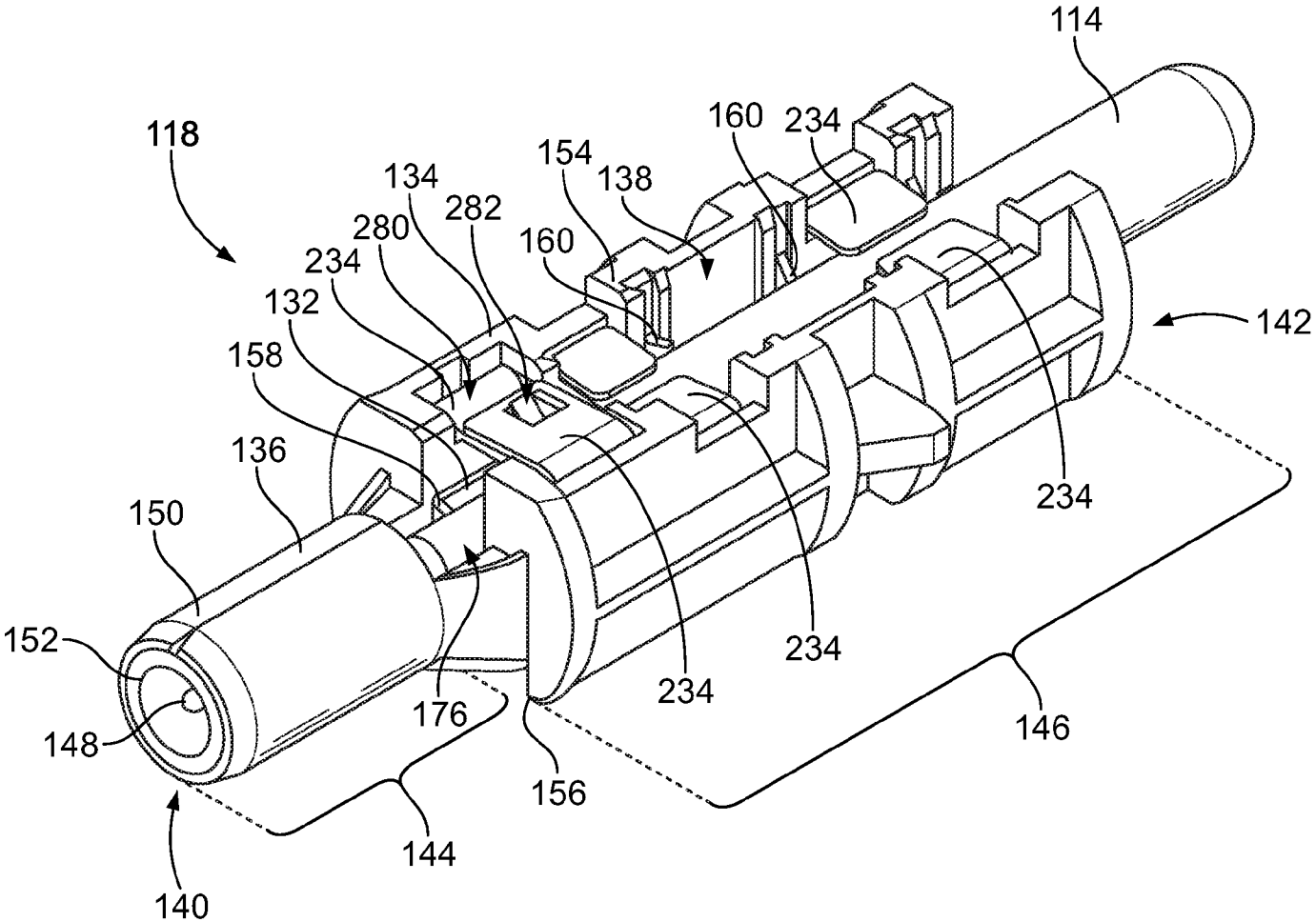
FIG. 2 is top perspective view of a contact subassembly of a male connector and a cable according to an embodiment.

FIG. 2 is top perspective view of the contact subassembly 118 of the male connector 102 (shown in FIG. 1) and the cable 114 according to an embodiment. The housing 108 of the male connector 102 is not shown in FIG. 2. The contact subassembly 118 includes a center contact 132, a dielectric holder 134, and an outer contact 136. Although FIG. 2 shows the contact subassembly 118 of the male connector 102, the following description of various embodiments of the contact subassembly 118 may also apply to the contact subassembly 120 (shown in FIG. 1) of the female connector 104 (FIG. 1). For example, the contact subassembly 120 of the female connector 104 may have components similar in shape, orientation, and function as the components of the contact subassembly 118 described herein.

The contact subassembly 118 extends between a mating end 140 and an opposite cable end 142. The contact subassembly 118 includes a cylindrical mating portion 144 extending to the mating end 140 and a termination portion 146 between the mating portion 144 and the cable end 142. The mating portion 144 includes a mating interface 148 of the center contact 132, a cylindrical mating segment 150 of the outer contact 136, and a hollow shaft 152 of the dielectric holder 134 disposed radially between the mating interface 148 and the cylindrical mating segment 150. The mating portion 144 is configured to engage complementary components of the contact subassembly 120 (shown in FIG. 1) of the female connector 102 (FIG. 1) when mated.

The termination portion 146 of the contact subassembly 118 is configured to mechanically and electrically connect to the cable 114. The cable 114 extends from the cable end 142 of the contact subassembly 118. The dielectric holder 134 extends between a top side 154 and an opposite bottom side 156. As used herein, relative or spatial terms such as "front," "rear," "top," "bottom," "first," and "second" are only used to distinguish the referenced elements and do not necessarily require particular positions or orientations relative to the surrounding environment of the connector system 100 (shown in FIG. 1). The dielectric holder 134 defines a channel 138 along a length of the termination portion 146. The channel 138 is open along the top side 154 of the holder 134, such that the dielectric holder 134 resembles a cradle or trough. The channel 138 receives the cable 114 therein to terminate the cable 114 to the contact subassembly 118. The channel 138 includes at least one cable insulation displacement (CID) feature 158 of the center contact 132 and at least one CID feature 160 of the outer contact 136 therein. The CID features 158, 160 are configured to penetrate one or more layers of the cable 114 for providing an electrical connection and/or strain relief. In an embodiment, the center contact 132 and the outer contact 136 are mounted to the dielectric holder 134 prior to the cable 114 such that the CID features 158, 160 are disposed in the channel 138 when the cable 114 is loaded into the channel 138. Thus, the dielectric holder 134 may be pre-loaded with the center contact 132 and the outer contact 136 prior to the introduction of the cable 114.

The contact subassembly 118 according to one or more embodiments described herein is designed to provide a one-step press termination of the cable 114 to the contact subassembly 118. The cable 114 is introduced to the contact subassembly 118 by lowering the cable 114 into the channel 138 from above the top side 154 of the dielectric holder 134. For example, the cable 114 may be pressed into the channel 138 manually or via an automated machine, such as a press device. As the cable 114 is pressed into the channel 138, the CID features 158, 160 of the center contact 132 and the outer contact 136, respectively, engage the cable 114 and penetrate various layers thereof to terminate the cable 114 to the contact subassembly 118. For example, the CID feature 158 of the center contact 132 is configured to penetrate one or more layers of the cable 114 to engage a core conductor 162 (shown in FIG. 3) of the cable 114 in order to electrically connect the center contact 132 to the core conductor 162. At least one CID feature 160 of the outer contact 136 is configured to penetrate one or more layers of the cable 114 to engage a shield layer 164 (shown in FIG. 3) of the cable 114 in order to electrically connect the outer contact 136 to the shield layer 164. Therefore, the contact subassembly 118 allows the cable 114 to terminate to both the center contact 132 and the outer contact 136 by a single press of the cable 114 into the channel 138.

The contact subassembly 118 described herein may improve the efficiency (for example, reduce time consumption and/or cost) of producing coaxial cable connectors compared to known cable connectors. For example, the assembly of the contact subassembly 118 may reduce the number of assembly steps compared to known cable connectors which crimp the center contact to the core conductor of the cable and the outer contact to the shield conductor of the cable in two different crimp applications. Furthermore, the contact subassembly 118 may improve efficiency by having fewer discrete parts than known cable connectors that include, for example, a ferrule that is crimped onto the outer contact and the cable for strain relief.

Figure 3:
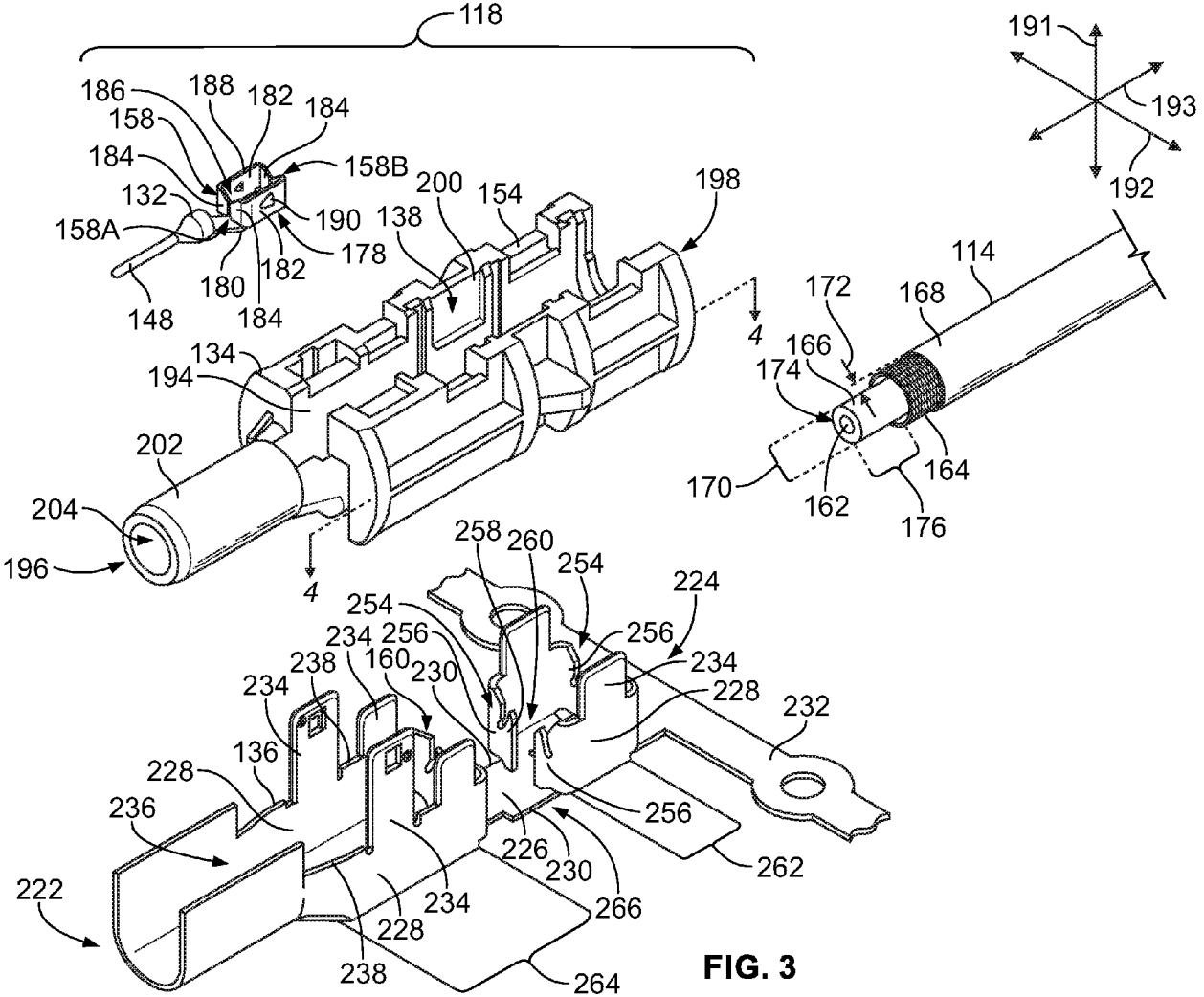
FIG. 3 is an exploded perspective view of the contact subassembly and the cable shown in FIG. 2.

FIG. 3 is an exploded perspective view of the contact subassembly 118 and the cable 114 shown in FIG. 2. The outer contact 136 of the contact subassembly 118 is shown in a pre-assembled state. The exploded contact subassembly 118 and cable 114 are oriented with respect to a vertical or elevation axis 191, a lateral axis 192, and a longitudinal axis 193. The axes 191-193 are mutually perpendicular. Although the vertical axis 191 appears to extend generally parallel to gravity, it is understood that the axes 191-193 are not required to have any particular orientation with respect to gravity.

The cable 114 is a coaxial cable including the core conductor 162 and the shield layer 164 as the two conductive coaxial components. The core conductor 162 includes one or more electrical wires composed of a conductive metal material, such as copper, silver, gold, and/or the like. The core conductor 162 is surrounded by an insulation layer 166 that is formed of a dielectric material, such as one or more plastics. The insulation layer 166 protects and electrically insulates the core conductor 162 from the conductive shield layer 164 that surrounds the insulation layer 166. The conductive shield layer 164 provides electrical shielding of the signals transmitted along the core conductor 162, and may also provide an electrical grounding path and/or signal return path. The conductive shield layer 164 may be or include a cable braid that includes woven or braided metal strands. Optionally, the conductive shield layer 164 may include a metallic foil instead of, or in addition to, a cable braid. A jacket 168 of the cable 114 surrounds the shield layer 164. The jacket 168 is formed of a dielectric material, such as one or more plastics. The jacket 168 provides protection against abrasions and contaminants. The jacket 168 also electrically insulates the conductive components 162, 164 of the cable 114 from electrical shorting.

As used herein, the term "surrounding" means extending around a periphery of another object in at least one dimension, such as encircling the object along a segment of the length of the object. The term "surrounding" as used herein does not necessarily require that the surrounded object be completely enclosed or encased by the surrounding object in all dimensions.

As used herein, the cable 114 is described as having an inner cable portion 170 and an outer cable portion 172 that surrounds the inner cable portion 170. The inner cable portion 170 is composed of the core conductor 162 and the insulation layer 166, and the outer cable portion 172 is composed of the shield layer 164 and the jacket 168. In an embodiment, the cable 114 may be prepared for termination to the contact subassembly 118 by stripping an end 174 of the cable 114. In the illustrated embodiment, the jacket 168 and shield layer 164 are stripped from an end segment 176 of the cable 114 such that the inner cable portion 170 protrudes from the outer cable portion 172 along the end segment 176. The cable 114 may be prepared as shown in the illustrated embodiment prior to pressing the cable 114 into the channel 138 of the dielectric holder 134. Although the shield layer 164 protrudes beyond the jacket 168 and extends more proximate to the end 174 of the cable 114 than the jacket 168 in the illustrated embodiment, the shield layer 164 may be severed at the same location as the jacket 168 in an alternative embodiment. In another alternative embodiment, the cable 114 may not be stripped at the end 174 of the cable 114.

The center contact 132 includes the mating interface 148 and a termination region 178. The mating interface 148 in the illustrated embodiment is a pin, but the mating interface 148 may have other shapes in other embodiments, such as a socket, a blade, or the like. The termination region 178 includes the CID feature 158 that is configured to penetrate one or more layers of the cable 114 to engage the core conductor 162. As used herein, the CID feature 158 may be referred to as a first CID feature 158 and a core-terminating CID feature 158. The termination region 178 includes a bottom wall 180 and two side walls 182 extending vertically upwards from the bottom wall 180. The CID feature 158 is located between the side walls 182. The CID feature 158 includes two contact walls 184 that define a core slot 186 therebetween. The contact walls 184 each extend from one of the side walls 182 laterally towards the other contact wall 184.

The core slot 186 is open along a top 188 of the center contact 132 to receive the end segment 176 of the cable 114 therein. In an alternative embodiment, the CID feature 158 includes a single contact wall 184 that has a cut-out slot defining the core slot 186 instead of the core slot 186 being defined between two contact walls 184. The core slot 186 may be sized to have a width that is smaller than or equal to a diameter of the core conductor 162 such that the contact walls 184 penetrate the insulation layer 166 as the end segment 176 of the cable 114 is pressed into the CID feature 158. The contact walls 184 may be tapered to provide a lead-in area that guides the end segment 176 into the core slot 186. The edges of the contact walls 184 along the lead-in area and along the core slot 186 optionally may be sharpened to slice through the insulation layer 166. In an alternative embodiment, the CID feature 158 may be configured to slice through the jacket layer 168 and the shield layer 164 as well as the insulation layer 166. Thus, in an alternative embodiment, the cable 114 may not be stripped prior to being pressed into the CID feature 158 of the center contact 132.

In the illustrated embodiment, the termination region 178 of the center contact 132 includes two CID features 158 spaced apart longitudinally such that a front CID feature 158A is disposed axially between the mating interface 148 and a rear CID feature 158B. The termination region 178 has a box shape defined by the bottom wall 180, the side walls 182 and the contact walls 184 of the CID features 158. The termination region 178 is open along the top 188 to allow the end segment 176 of the cable 114 to be received in the core slots 186 of the CID features 158.

In an embodiment, the side walls 182 of the termination region 178 include retention barbs 190 that extend laterally outward from the side walls 182. The retention barbs 190 are protrusions that may have various shapes, such as rounded bumps or pointed pyramids. The retention barbs 190 are configured to engage inner walls 194 of the dielectric holder 134 to retain the termination region in the channel 138 of the dielectric holder 134. The center contact 132 may be composed of a conductive metal material including copper, silver, aluminum, gold, and/or the like. The center contact 132 may be stamped and formed from an at least partially planar panel into the illustrated shape.

The dielectric holder 134 is configured to hold the center contact 132 and the outer contact 136. The dielectric holder 134 is composed of a dielectric material, such as one or more plastics, to allow the holder 134 to electrically insulate the center contact 132 from the outer contact 136. The dielectric holder 134 may be formed via a molding process. The dielectric holder 134 extends between a front end 196 and a rear end 198. The channel 138 is defined in a body 200 of the dielectric holder 134. The channel 138 extends along the longitudinal axis 193. The channel 138 may extend the full length of the body 200. The dielectric holder 134 also includes a nose segment 202 that extends from the body 200 to the front end 196. The nose segment 202 includes a shaft that defines a cylindrical cavity 204. The cylindrical cavity 204 aligns with the channel 138 and is fluidly open to the channel 138. Unlike the channel 138, which is open at the top side 154 of the dielectric holder 134, the cylindrical cavity 204 may be closed (for example, not open at the top side 154).

Figure 4:
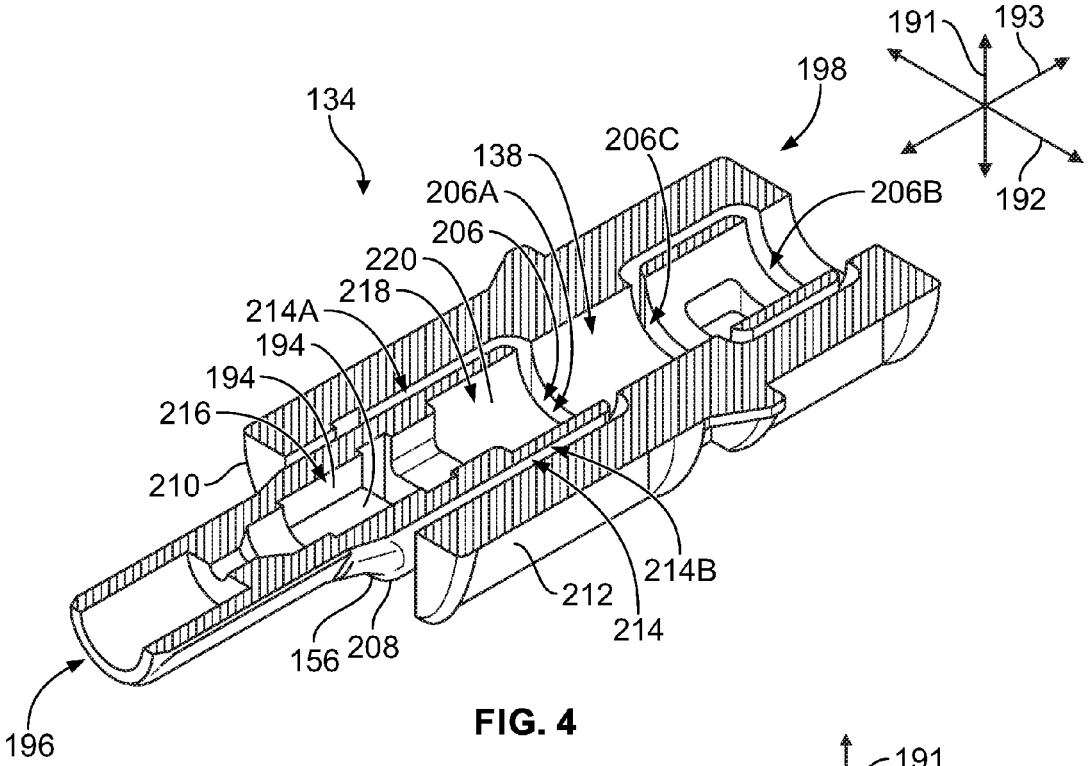
FIG. 4 is a perspective top-down cross-sectional view of a dielectric holder of the contact subassembly taken along line 4-4 shown in FIG. 3.

FIG. 4 is a perspective top-down cross-sectional view of the dielectric holder 134 taken along line 4-4 shown in FIG. 3. The channel 138 includes at least one aperture 206 extending through the dielectric holder 134 from an outer surface 208 to the channel 138. In the illustrated embodiment, the outer surface 208 is along the bottom side 156 of the dielectric holder 134. In an alternative embodiment, one or more apertures may extend from the outer surface 208 along a left lateral side 210 and/or a right lateral side 212 of the holder 134 instead of, or in addition to, the bottom side 156. In the illustrated embodiment, the dielectric holder 134 defines multiple apertures 206 including a front aperture 206A, a rear aperture 206B, and an intermediate aperture 206C located between the front and rear apertures 206A, 206B. The intermediate and rear apertures 206B, 206C are located rearward of the front aperture 206A.

In an embodiment, the channel 138 includes a front segment 216 and a rear segment 218. The front segment 216 of the channel 138 is sized and shaped to accommodate the termination region 178 (shown in FIG. 3) of the center contact 132 (FIG. 3). For example, the front segment 216 is defined by planar inner walls 194 that may intersect at right angles to accommodate the box-shaped termination region 178. The rear segment 218 of the channel 138 is disposed rearward of the front segment 216 and is sized and shaped to accommodate the outer cable portion 172 (shown in FIG. 3) of the cable 114 (FIG. 3). For example, the rear segment 218 has a concave interior surface 220 that is sized to accommodate an outer perimeter of the jacket 168 (FIG. 3) of the cable 114.

The dielectric holder 134 defines side cavities 214 located on opposite lateral sides of the channel 138. For example, a left side cavity 214A is disposed between the left lateral side 210 of the holder 134 and the channel 138, and a right side cavity 214B is disposed between the channel 138 and the right lateral side 212. Each side cavity 214 extends between the bottom side 156 of the holder 134 such that the side cavities 214 are open along the bottom side 156. In an embodiment, the side cavities 214 extend to the top side 154 (shown in FIG. 3) and are at least partially open along the top side 154. The side cavities 214 extend generally along the longitudinal axis 193. The side cavities 214 may intersect at least some of the apertures 206. Although not shown, the dielectric holder 134 may include bridging features within the side cavities 214 that extend across the side cavities 214 to maintain the dielectric holder 134 as a unitary, one-piece member.

Referring now back to FIG. 3, the outer contact 136 is composed of a conductive metal material, including one or more of copper, silver, aluminum, gold, or the like. The outer contact 136 in an embodiment may be stamped and formed from a planar panel. The outer contact 136 is configured to at least partially surround the dielectric holder 134. The outer contact 136 extends from a front end 222 to a rear end 224. The front end 222 at least partially surrounds the mating interface 148 of the center contact 132 when the contact subassembly 118 is assembled. The rear end 224 is attached to a carrier strip 232 in the illustrated embodiment. The outer contact 136 may be connected to other outer contacts via the carrier strip 232. In the illustrated embodiment, the outer contact 136 includes a base wall 226 that extends the length of the outer contact 136. Side walls 228 of the outer contact 136 extend generally vertically upwards from opposite edges 230 of the base wall 226. The base wall 226 and the side walls 228 may define a chamber 236 that receives at least a portion of the dielectric holder 134 therein. The side walls 228 may include holding tabs 234 extending vertically from top edges 238 of the side walls 228.

The CID feature 160 of the outer contact 136 extends generally vertically from the base wall 226. The CID feature 160 is configured to penetrate one or more layers of the cable 114 to engage the shield layer 164 in order to electrically connect the outer contact 136 to the shield layer 164. As used herein, the CID feature 160 may be referred to as a second CID feature 160 and a shield-terminating CID feature 160.

Figure 5:
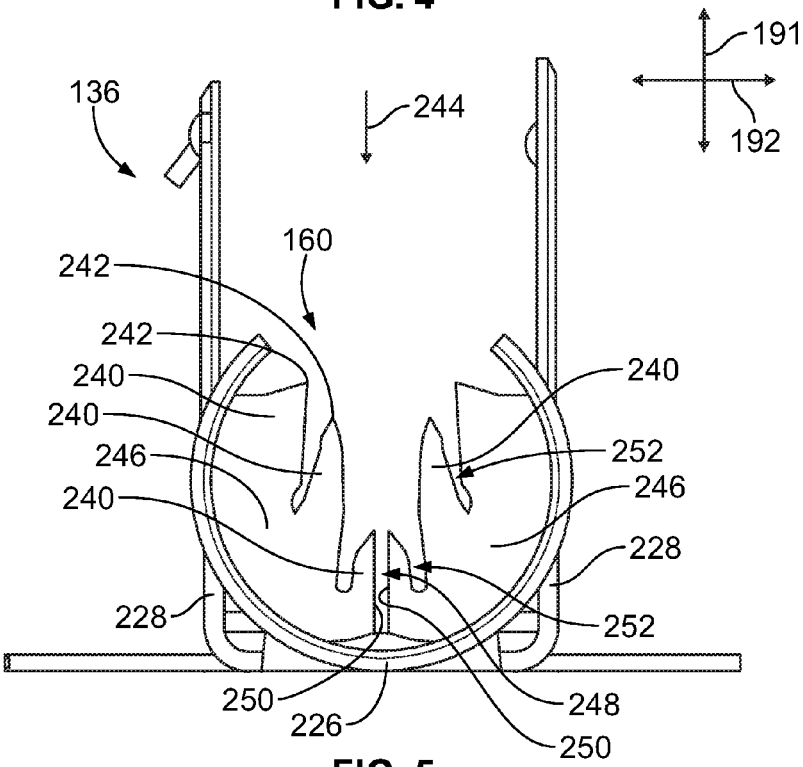
FIG. 5 is a front view of an outer contact of the contact subassembly showing a shield-terminating CID feature according to an embodiment.

FIG. 5 is a front view of the outer contact 136 showing the shield-terminating CID feature 160 according to an embodiment. The CID feature 160 includes multiple blades 240 having pointed tips 242 that are configured to penetrate at least the jacket 168 (shown in FIG. 3) of the cable 114 (FIG. 3) to engage and electrically connect to the shield layer 164 (FIG. 3). The blades 240 are oriented generally vertically and extend upwards away from the base wall 226. The blades 240 are oriented to allow the pointed tips 242 to dig into the cable 114 as the cable 114 is loaded in a downward pressing direction 244 relative to the outer contact 136. The blades 240 may penetrate at least partially through the shield layer 164 and may also extend into the insulation layer 166 (FIG. 3) of the cable 114 in order to ensure that a reliable mechanical and electrical connection is established with the shield layer 164. The blades 240 do not penetrate the insulation layer 166 far enough to engage the core conductor 162.

In the illustrated embodiment, the CID feature 160 includes two contact walls 246 that extend from corresponding side walls 228 laterally towards one another. Interior edges 250 of the contact walls 246 are spaced apart from each other by a gap 248. Each contact wall 246 in the illustrated embodiment includes three blades 240. The contact walls 246 are formed such that a relative height of the pointed tips 242 of the blades 240 of each contact wall 246 relative to the base wall 226 decreases with lateral distance from the corresponding side wall 228 to the respective interior edge 250. Thus, the heights of the contact walls 246 generally taper towards the gap 248 to accommodate the cylindrical shape of the cable 114. In the illustrated embodiment, each blade 240 at least partially defines a receiving slot 252 that extends generally downwards towards the base wall 226. The receiving slots 252 are defined between adjacent blades 240 on each contact wall 246. In addition to extending downward, the receiving slots 252 may extend at least partially laterally outward towards the corresponding side walls 228. As the cable 114 engages the CID feature 160, the blades 240 may shear layers of the cable 114, and sheared portions of the cable 114 may be received in the receiving slots 252 as the cable 114 moves downward relative to the CID feature 160. For example, sheared portions of the shield layer 164 may accumulate in the receiving slots 252, which supports the electrical connection between the outer contact 136 and the cable 114 by increasing the contact surface area.

Referring now back to FIG. 3, the outer contact 136 may also include another CID feature 254 that is located rearward of the CID feature 160. The CID feature 254 is configured to provide strain relief, and is referred to herein as a strain relief CID feature 254 and a third CID feature 254 (based on the core-terminating CID feature 158 of the center contact 132 being the "first CID feature" and the shield-terminating CID feature 160 of the outer contact 136 being the "second CID feature"). The strain relief CID feature 254 is located rearward of the shield-terminating CID feature 160. The strain relief CID feature 254 may be similar to the shield-terminating CID feature 160 in shape and function. For example, the strain relief CID feature 254 is located laterally between the side walls 228, and is composed of two contact walls 256 that each include at least one blade 258. The contact walls 256 are separated from each other by a gap 260. In the illustrated embodiment, each contact wall 256 defines only one blade 258. The blades 258 may be configured to penetrate the jacket 168, the shield layer 164, and at least partially into the insulation layer 166 in order to provide mechanical retention and strain relief. Optionally, the gap 260 of the strain relief CID feature 254 has a greater width than the gap 248 (shown in FIG. 5) of the shield-terminating CID feature 160. In the illustrated embodiment, the outer contact 136 includes two strain relief CID features 254 that are both rearward of the shield-terminating CID feature 160. The outer contact 136 may have other numbers of shield-terminating CID features 160 and strain relief CID features 254 in alternative embodiments.

In the illustrated embodiment, the side walls 228 of the outer contact 136 are segmented to define a strain relief segment 262 and a shielding segment 264 which are spaced apart longitudinally by a bridge portion 266 of the base wall 226. The shield-terminating CID feature 160 is located along the shielding segment 264, and the strain relief CID features 254 are located along the strain relief segment 262. Optionally, the base wall 226 may be severed along the bridge portion 266 after the cable 114 is terminated to the contact subassembly 118 in order to separate the mechanical function of the strain relief segment 262 from the electrical function of the shielding segment 264.

Figure 6:
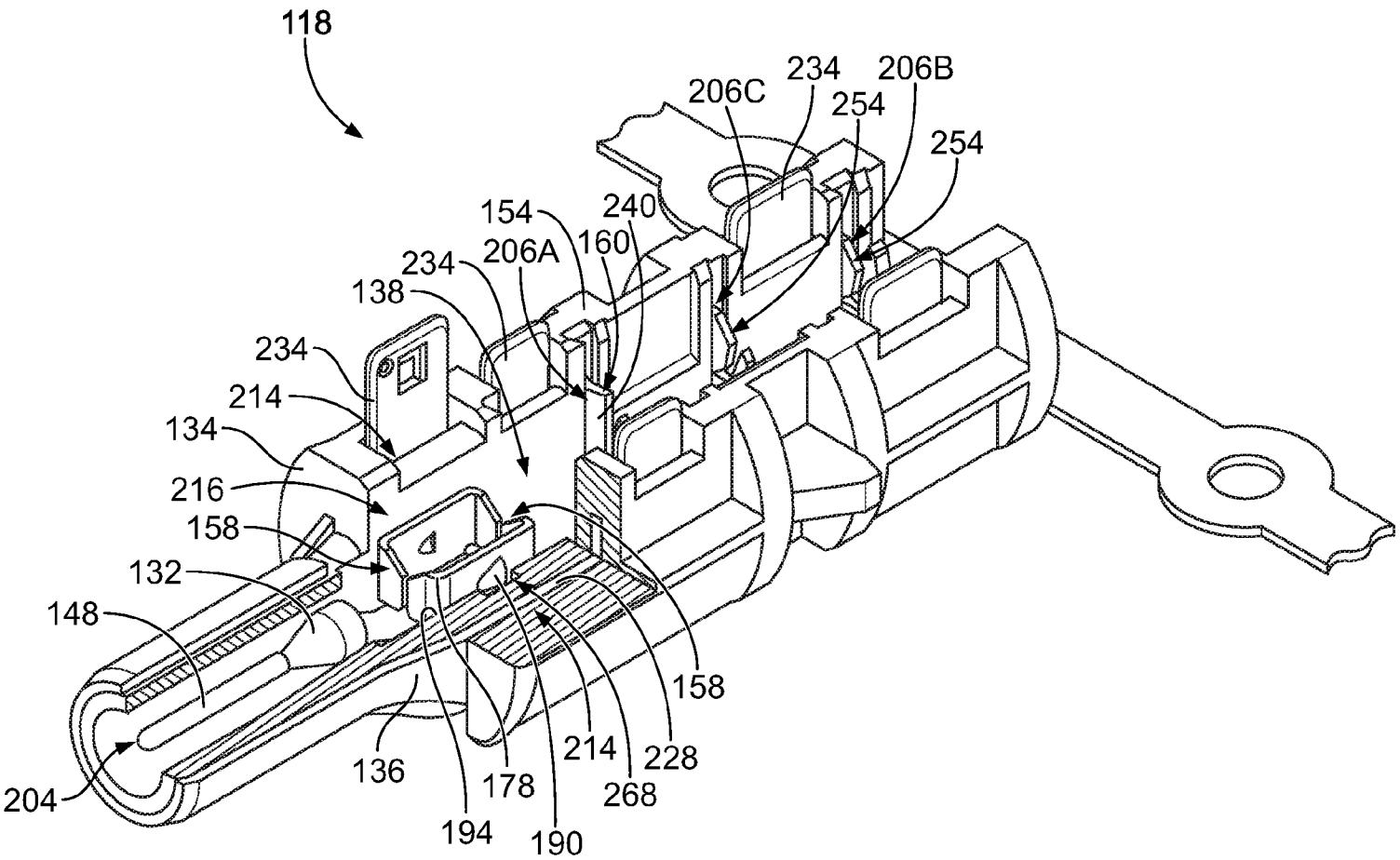
FIG. 6 is a perspective, partial cross-sectional view of the contact subassembly in an assembled state according to an embodiment.
Figure 7:
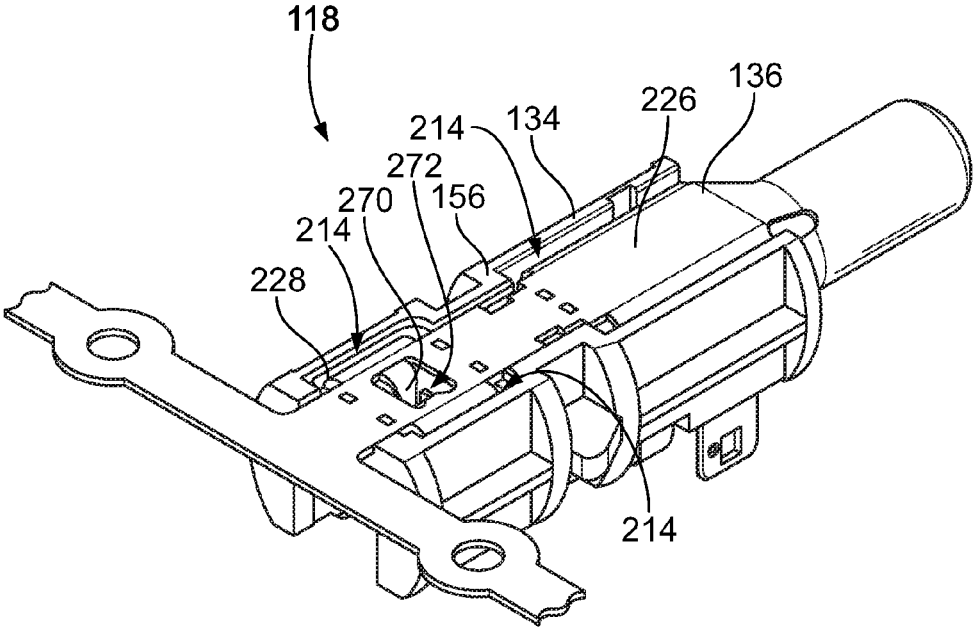
FIG. 7 is a bottom perspective view of the contact subassembly of FIG. 6.
Figure 8:
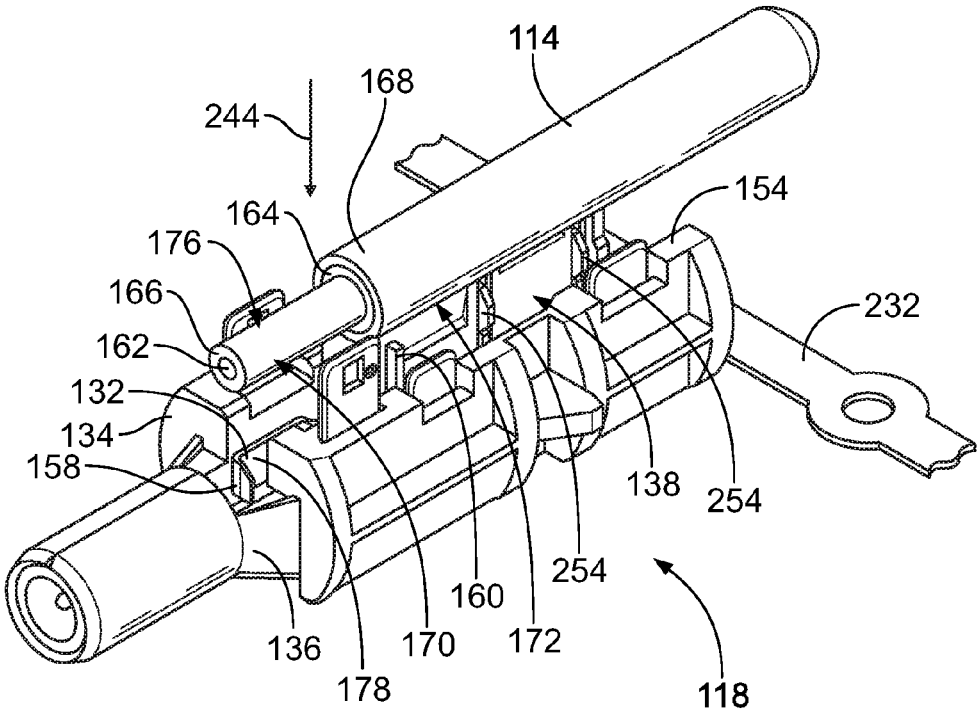
FIG. 8 is a top perspective view of the contact subassembly poised for terminating to the cable according to an embodiment.

FIGS. 6-8 show various perspective views of the contact subassembly 118 as the contact subassembly 118 is prepared for termination to the coaxial cable 114 (shown in FIG. 8). FIG. 6 is a perspective, partial cross-sectional view of the contact subassembly 118 in an assembled state according to an embodiment. FIG. 7 is a bottom perspective view of the contact subassembly 118 of FIG. 6. FIG. 8 is a top perspective view of the contact subassembly 118 poised for terminating to the cable 114 according to an embodiment.

With reference to FIG. 6, the center contact 132 is loaded into the dielectric holder 134 during assembly such that the termination region 178 is held in the front segment 216 of the channel 138 and the mating interface 148 extends into the cylindrical cavity 204. The core-terminating CID features 158 on the termination region 178 are disposed in the channel 138. The retention barbs 190 of the center contact 132 are received in respective recesses 268 defined along the inner walls 194 to align and/or retain the center contact 132 in position relative to the dielectric holder 134.

The outer contact 136 is coupled to the dielectric holder 134 before, after, or at the same time that the center contact 132 is loaded into the dielectric holder 134. As shown in FIG. 7, the base wall 226 of the outer contact 136 engages the bottom side 156 (for example, an outer surface) of the dielectric holder 134. The side walls 228 of the outer contact 136 extend through the corresponding side cavities 214 of the dielectric holder 134 from the bottom side 156 towards the top side 154. As shown in FIG. 6, the holding tabs 234 of the outer contact 136 protrude from the side cavities 214 at the top side 154. The shield-terminating CID feature 160 extends through the front aperture 206A in the dielectric holder 134 such that the blades 240 protrude into the channel 138. The strain relief CID features 254 extend through the rear and intermediate apertures 206B, 206C and protrude into the channel 138 rearward of the shield-terminating CID feature 160. All three of the CID features 160, 254 shown in FIG. 6 are disposed in the channel 138 rearward of the center contact 132.

As shown in FIG. 7, optionally the outer contact 136 may be secured in place on the dielectric holder 134 by punching or otherwise deflecting one or more locking tabs 270 along the base wall 226 into a depression or opening 272 of the dielectric holder 134.

With reference now to FIG. 8, the cable 114 is terminated to the contact subassembly 118 (to mechanically and electrically connect the cable 114 to the contact subassembly 118) by lowering the cable 114 relative to the contact subassembly 118 into the channel 138 from above the top side 154 of the dielectric holder 134. The cable 114 may be lowered into the channel 138 manually or automatically by a pressing machine. The cable 114 is aligned with the channel 138 and poised for terminating to the contact subassembly 118 in the illustrated embodiment, such that movement of the cable 114 in a vertically downward pressing direction 244 terminates the cable 114. As shown in FIG. 8, the end segment 176 of the cable 114 aligns axially with the termination region 178 of the center contact 132. Therefore, the inner cable portion 170 engages the one or more core-terminating CID features 158 of the center contact 132 to electrically connect the core conductor 162 to the center contact 132 during the pressing operation. In addition, the outer cable portion 172 of the cable 114 aligns with the shield-terminating CID feature 160 and the strain relief CID features 254 such that the pressing operation causes the CID features 160, 254 to penetrate at least the jacket 168 of the cable 114 without penetrating fully through the insulation layer 166 to the core conductor 162. Therefore, a single, one-shot press of the cable 114 into the channel 138 is configured to terminate the core conductor 162 to the center contact 132 (via the core-terminating CID feature 158) and the shield layer 164 to the outer contact 136 (via the shield-terminating CID feature 160).

As shown in FIGS. 6-8, the contact subassembly 118 may be assembled while the outer contact 136 remains connected to the carrier strip 232. For example, multiple assembled contact subassemblies 120 may be transported together on the same carrier strip. The contact subassembly 118 is removed from the carrier strip 232 prior to use of the electrical connector 102 (shown in FIG. 1).

Referring now back to FIG. 2, once the cable 114 is pressed into the channel 138, the holding tabs 234 may be bent or folded across the channel 138 above a top of the cable 114. The holding tabs 234 may provide mechanical retainment of the cable 114 in the channel 138. A first pair 280 of opposing holding tabs 234 aligns with the termination region 178 of the center contact 132. The tabs 234 of the first pair 280 overlap across the channel 138 and optionally include a complementary latching mechanism 282 to retain the tabs 234 of the first pair 280 in the overlapped position. The holding tabs 234 may provide electrical shielding for the cable 114. For example, the tabs 234 of the first pair 280 that overlap each other may shield the termination region 178 on all sides.

Figure 9:
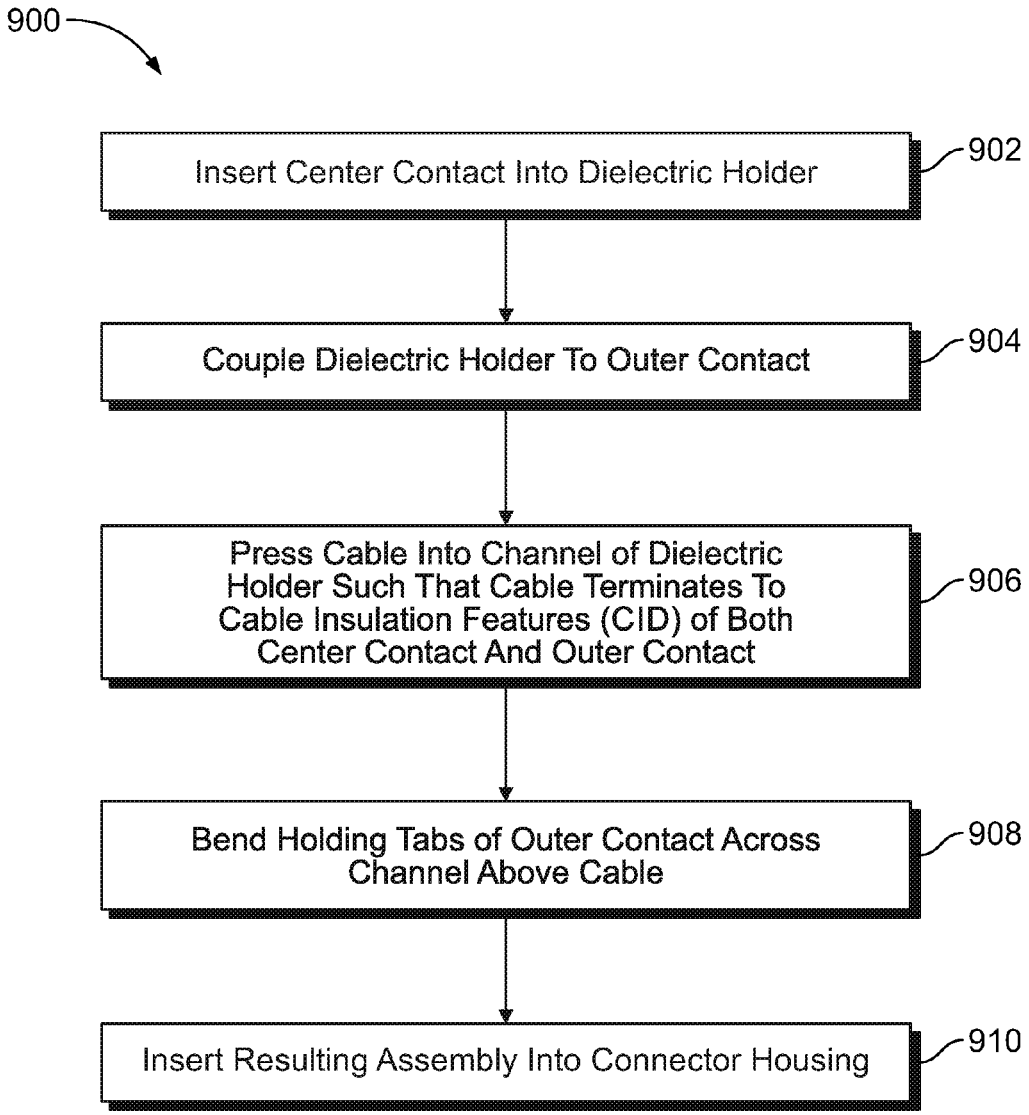
FIG. 9 is a flow chart of a method for assembling an electrical cable connector according to an embodiment.

FIG. 9 is a flow chart of a method 900 for assembling an electrical cable connector according to an embodiment. The method 900 may be performed to assemble the electrical connector 102 and/or the electrical connector 104 shown in FIG. 1. For example, the method 900 may be performed using the components of the contact subassembly 118 and the coaxial cable 114. At 902, a center contact is inserted into a dielectric holder. The dielectric holder has a top side and defines a channel that is open at the top side. The center contact has a mating interface and a termination region. The termination region is received in the channel of the dielectric holder. The termination region includes a first cable insulation displacement (CID) feature. The first CID feature has two contact walls that define a core slot therebetween.

At 904, the dielectric holder is coupled to an outer contact that at least partially surrounds the dielectric holder. The outer contact includes a base wall and a second CID feature extending from the base wall. The base wall engages an outer surface of the dielectric holder. The second CID feature extends through an aperture of the dielectric holder into the channel. The second CID feature includes multiple blades having pointed tips. The outer contact further includes two side walls extending from opposite edges of the base wall. The side walls include holding tabs that extend from respective top edges of the side walls. Although step 902 is presented in the flow chart prior to step 904, the method 900 may be performed with step 902 accomplished prior to or concurrently with step 904.

At 906, a coaxial cable is pressed into the channel of the dielectric holder from above the top side of the dielectric holder such that the cable engages and terminates to both the first CID feature of the center contact and the second CID feature of the outer contact as the cable is pressed into the channel. For example, the cable includes an inner cable portion having a core conductor and an insulation layer surrounding the core conductor, and the cable further includes an outer cable portion having a shield layer surrounding the insulation layer and a jacket that surrounds the shield layer. The inner cable portion protrudes from the outer cable portion at an end segment of the cable. The inner cable portion along the end segment engages the first CID feature of the center contact, and the contact walls of the first CID feature penetrate the insulation layer to engage and electrically connect to the core conductor of the cable that is received in the core slot. The outer cable portion engages the second CID feature of the outer contact as the cable is pressed into the channel of the dielectric holder, and the blades penetrate the jacket of the cable to engage and electrically connect to the shield layer of the cable.

In an alternative embodiment, the cable does not include an end segment of the inner cable portion protruding from the outer cable portion. The outer cable portion of the cable engages both the first and second CID features, and the first CID feature penetrates the jacket of the cable, the shield layer, and the insulation layer to engage and electrically connect to the core conductor.

At 908, the holding tabs of the outer contact are bent across the channel above the cable in the channel. Thus, the holding tabs extend over a top of the cable and may provide mechanical retainment of the cable in the channel. At 910, the resulting assembly is inserted into a connector housing and is secured within the housing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A contact subassembly for an electrical cable connector comprising:

a center contact having a mating interface and a termination region, the termination region including a first cable insulation displacement (CID) feature defining a core slot sized to receive and engage a core conductor of a cable therein;

a dielectric holder having a top side and defining a channel that is open at the top side, the center contact held by the dielectric holder such that the termination region is received in the channel, the dielectric holder further defining an aperture extending through the dielectric holder from an outer surface thereof to the channel; and an outer contact including a base wall and a second CID feature extending from the base wall, the base wall engaging the outer surface of the dielectric holder, the second CID feature extending through the aperture into the channel, the second CID feature including blades that penetrate a jacket of the cable to engage and electrically connect to a shield layer of the cable as the cable is loaded into the channel from above the top side of the dielectric holder.

2. The contact subassembly of claim 1, wherein the base wall of the outer contact engages a bottom side of the dielectric holder that is opposite the top side, the outer contact further including side walls extending from edges of the base wall towards the top side of the dielectric holder, the side walls including holding tabs extending across the channel at the top side of the dielectric holder to hold the cable in the channel.

3. The contact subassembly of claim 2, wherein the dielectric holder defines side cavities located on opposite lateral sides of the channel, each side cavity extending between the bottom side and the top side of the dielectric holder and receiving a corresponding side wall of the outer contact therein, the holding tabs protruding from the side cavities at the top side of the dielectric holder.

4. The contact subassembly of claim 2, wherein the holding tabs of the outer contact in a first pair of opposing holding tabs align with the termination region of the center contact and overlap each other above the termination region.

5. The contact subassembly of claim 1, wherein the dielectric holder extends between a front end and a rear end and the aperture of the dielectric holder is a front aperture located axially between the center contact in the channel and the rear end of the dielectric holder, the dielectric holder further including a rear aperture located rearward of the front aperture, the outer contact further including a third CID feature that extends from the base wall through the rear aperture into the channel of the dielectric holder, the third CID feature including blades that penetrate at least the jacket of the cable as the cable is loaded into the channel from above the top side of the dielectric holder to provide strain relief.

6. The contact subassembly of claim 1, wherein the dielectric holder includes a body that defines the channel and a nose segment extending from the body, the nose segment defining a closed cylindrical cavity that aligns with the channel, the center contact held by the dielectric holder such that the termination region is held in the channel and the mating interface of the center contact extends into the cylindrical cavity.

7. The contact subassembly of claim 1, wherein the termination region of the center contact includes two side walls, the first CID feature located between the side walls, the side walls including retention barbs that extend laterally outward from the side walls and engage inner walls of the dielectric holder to retain the termination region in the channel.

8. The contact subassembly of claim 1, wherein the blades of the second CID feature extend upwards away from the base wall of the outer contact to respective pointed tips, each blade at least partially defining a corresponding receiving slot extending generally downwards towards the base wall, each receiving slot configured to receive a sheared portion of the cable therein.

9. The contact subassembly of claim 1, wherein the mating interface of the center contact is at least one of a pin, a socket, or a blade.

10. The contact subassembly of claim 1, wherein a front end of the outer contact at least partially surrounds the mating interface of the center contact and a rear end of the outer contact is attached to a carrier strip.

11. An electrical cable connector comprising:

a cable including an inner cable portion including a core conductor and an insulation layer surrounding the core conductor, the cable further including an outer cable portion including a shield layer surrounding the insulation layer and a jacket surrounding the shield layer, the inner cable portion protrudes from the outer cable portion at an end segment of the cable; and a contact subassembly including a center contact, a dielectric holder, and an outer contact, the dielectric holder having a top side and defining a channel that is open at the top side, the center contact having a mating interface and a termination region, the center contact being held by the dielectric holder such that the termination region is disposed in the channel, the termination region including a first cable insulation displacement (CID) feature having two contact walls that define a core slot therebetween, the outer contact mounted to the dielectric holder and including a second CID feature within the channel of the dielectric holder, the second CID feature within the channel including blades that extend towards the top side of the dielectric holder to respective pointed tips, wherein the cable is received in the channel of the dielectric holder from above the top side of the dielectric holder such that the inner cable portion of the end segment is received in the core slot of the first CID feature and the outer cable portion engages the pointed tips of the blades of the second CID feature as the cable is received in the channel, the contact walls of the first CID feature penetrating the insulation layer to engage and electrically connect to the core conductor of the cable, the blades of the second CID feature penetrating the jacket of the cable and engaging and electrically connecting to the shield layer.

12. The electrical cable connector of claim 11, wherein the dielectric holder extends between a front end and a rear end, the dielectric holder defining an aperture extending through the dielectric holder from an outer surface thereof to the channel, the aperture located rearward of the center contact in the channel, the outer contact including a base wall that engages the outer surface of the dielectric holder, wherein the blades of the second CID feature extend from the base wall through the aperture into the channel.

13. The electrical cable connector of claim 11, wherein the dielectric holder extends between a front end and a rear end, the channel including a front segment and a rear segment, the front segment sized to accommodate the termination region of the center contact, the rear segment having a concave interior surface sized to accommodate an outer perimeter of the outer cable portion of the cable.

14. The electrical cable connector of claim 11, wherein the outer contact includes a base wall and two side walls extending from opposite edges of the base wall, the base wall engaging a bottom side of the dielectric holder that is opposite the top side, the side walls extending through corresponding side cavities of the dielectric holder, the side cavities located on opposite lateral sides of the channel, the side cavities each extending between the top and bottom sides of the dielectric holder.

15. The electrical cable connector of claim 14, wherein the side walls include holding tabs that extend from respective top edges of the side walls, the holding tabs protruding from the side cavities at the top side of the dielectric holder, the holding tabs extending across the channel to hold the cable in the channel.

16. The electrical cable connector of claim 11, wherein the dielectric holder includes a body that defines the channel and a nose segment extending from the body, the nose segment defining a closed cylindrical cavity that aligns with the channel, the center contact held by the dielectric holder such that the termination region is held in the channel and the mating interface of the center contact extends into the cylindrical cavity.

17. A method of assembling an electrical cable connector comprising:

inserting a center contact into a dielectric holder, the dielectric holder having a top side and defining a channel that is open at the top side, the center contact having a mating interface and a termination region, the termination region received in the channel, the termination region including a first cable insulation displacement (CID) feature;

coupling the dielectric holder to an outer contact that at least partially surrounds the dielectric holder, the outer contact including a base wall and a second CID feature extending from the base wall, the base wall engaging an outer surface of the dielectric holder and the second CID feature extending through an aperture of the dielectric holder into the channel; and pressing a cable into the channel of the dielectric holder from above the top side of the dielectric holder such that the cable engages and terminates to both the first CID feature of the center contact and the second CID feature of the outer contact as the cable is pressed into the channel.

18. The method of claim 17, wherein the cable includes an inner cable portion including a core conductor and an insulation layer surrounding the core conductor, the cable further including an outer cable portion including a shield layer surrounding the insulation layer and a jacket surrounding the shield layer, the inner cable portion protrudes from the outer cable portion at an end segment of the cable, wherein the inner cable portion along the end segment engages the first CID feature of the center contact and the outer cable portion engages the second CID feature of the outer contact as the cable is pressed into the channel of the dielectric holder.

19. The method of claim 18, wherein the first CID feature has two contact walls that define a core slot therebetween, the contact walls of the first CID feature penetrating the insulation layer to engage and electrically connect to the core conductor of the cable that is received in the core slot, wherein the second CID feature includes multiple blades having pointed tips, the blades penetrating the jacket of the cable to engage and electrically connect to the shield layer of the cable.

20. The method of claim 17, wherein the outer contact includes two side walls extending from opposite edges of the base wall, the side walls including holding tabs that extend from respective top edges of the side walls, the method further comprising bending the holding tabs across the channel after the cable is pressed into the channel such that the holding tabs extend over a top of the cable.

* * * * *